US005496465A

United States Patent [19]

Fraas

[11] Patent Number: 5,496,465

[45] Date of Patent: Mar. 5, 1996

[54] VIBRATING BED COAL PYROLYSIS SYSTEM

[76] Inventor: Arthur P. Fraas, 1040 Scenic Dr., Knoxville, Tenn. 37919

[21] Appl. No.: 50,948

[22] Filed: Apr. 22, 1993

[51] Int. Cl.[6] ..... C10G 1/00; C10B 49/16; C10B 49/06; C10B 49/18

[52] U.S. Cl. ..... 208/400; 208/409; 208/411; 208/425; 208/427; 201/12; 201/33; 44/622

[58] Field of Search ..... 208/400, 409, 208/411, 425, 427; 201/12, 33; 44/622

[56] References Cited

U.S. PATENT DOCUMENTS

| | | | |
|---|---|---|---|
| 3,030,297 | 4/1962 | Schroeder | 208/8 |
| 3,127,744 | 4/1964 | Nettel | 60/49 |
| 3,234,735 | 2/1966 | Pirsh et al. | 60/39.18 |
| 3,855,070 | 12/1974 | Squires | 201/23 |
| 3,990,229 | 11/1976 | Staege | 69/39.02 |
| 4,013,516 | 3/1977 | Greenfield et al. | 201/2.5 |
| 4,116,005 | 9/1978 | Willyoung | 60/655 |
| 4,135,982 | 1/1979 | Green | 201/12 |
| 4,213,826 | 7/1980 | Eddinger et al. | 201/31 |
| 4,401,553 | 8/1983 | Faudel | 201/12 |
| 4,423,702 | 1/1984 | Ashworth et al. | 44/622 |
| 4,436,588 | 3/1984 | Rammler et al. | 201/33 |
| 4,533,463 | 8/1985 | Yan et al. | 208/409 |

OTHER PUBLICATIONS

Falkenberry et al., "Coal Pyrolysis–A DOE Perspective", Proceedings Of The EPRI Conference, (U.S.A. 1981).
Bund et al., "Combined Gas/Steam Turbine . . . ", Steag Anlagentechnik, (1970).
Durai–Swami, et al., "Controlled Flash Pyrolysis . . . ", Occidental Research Corp., DOE/PC/30264–21 (1982).
Durai–Swami, "Occidental's Flash Pyrolysis Coal Liquefaction Process . . . ", EPRI Conference, (1981).
Encyclopedia Britannica, "Coke, Coking and High Temperature Carbonization", vol. 5, p. 982 (1950).
EPRI, "Cool Water Coal Gasification Program", EPRI Report EPRI–AP–5931 (1988).
EPRI, "Coal Pyrolysis", Technical Brief RP2505 (1988).
Foster–Pegg, "The Atmospheric Fluid Bed with Carbonizer Coal Fired Combined Cycle", (1979).
A. P. Fraas, "Production of Motor Fuel and Methane . . . ", ASME Paper 80–WA/Fu–7 (1980).
J. B. Howard, "Coal Pyrolysis . . . ", EPRI Conference (1981).
R. W. Rammler, "The Lurgi–Ruhr Cas Process . . . ", EPRI Conference (1981).
J. F. Jones, "Project COED", AIChE (1974).
G. N. Richter, "Pilot Plant Evaluation of Illinois No. 6 . . . ", EPRI–AP–5029 (1987).
I. W. Smith, "New Approaches to Coal Pyrolysis . . . ", EPRI Conference (1981).

*Primary Examiner*—Paul Lieberman
*Assistant Examiner*—Patricia Hailey
*Attorney, Agent, or Firm*—James Creighton Wray

[57] ABSTRACT

A vibrating bed pyrolysis system has a vibrating bed which is supplied with hot solid particles. Dry coal particles are rapidly heated by the hot solid particles to drive off hydrocarbon vapors. The vapors are condensed in a jet condenser, and products are flowed to a header tank. A portion of the liquid product is stored at room temperature for later use. A small portion of the liquid product is pumped from the header tank and cooled to ambient temperature and is sprayed in the jet condenser, which is positioned above the vibrating pyrolysis bed. A dryer bed vibrated by the same vibrating machine which vibrates the pyrolysis bed is supplied with hot solid particles and the crushed coal. Moisture in the coal particles is evaporated, and water vapors entrain coal fines before the coal particles are passed to the pyrolysis bed. The hot solid particles are taken from a fluidized bed combustor and are returned to the combustor with the coal char particles by entrainment into the gas lift system. The water vapor and entrained coal fines from the dryer flow into the combustor and a non-condensable gaseous portion of the product flows from the header tank to the combustor.

15 Claims, 5 Drawing Sheets

VIBRATING BED PYROLYSIS SYSTEM

FIG. 4A TABLE I

COMPARISON OF KEY PARAMETERS FOR COAL PYROLYSIS SYSTEMS

| APPLICATION | GAS & LIQUID FUEL PRODUCTION | | | |
|---|---|---|---|---|
| TYPE OF BED | FIXED | MOVING | BUBBLING | ENTRAINED |
| PROCESS | COKE OVEN | LURGI GASIFIER | COED PYROLYSIS | OCCIDENTAL PYROLYSIS |
| REFERENCE | 5 | 2 | 12 | 3,4 |
| TYPE OF COAL | BITUMINOUS | BITUMINOUS | ILLINOIS-6 | KENTUCKY-9 |
| COAL CHEM. ENERGY IN PRODUCT, %[b] | | | | |
| GAS | 4 | 87 | 9 | 0.1 |
| LIQUID | 3 | 0 | 24 | 42.6 |
| CHAR | 80 | 0 | 51 | 37.7 |
| ENERGY CONV. EFF., %[c] | | 75 | 84 | 84 |
| ELEC. PROD. EFF., % | | | | |
| POWER TO COAL SYS., % | | | | |
| CAP. COST FACTORS | | | | |
| COAL FEED, lb/h-ft$^3$ | 3 | 17 | 12 | 1.5 |
| COAL TRANSIT TIME, s | 50,000 | 10,000 | 16,000 | 2 |
| PEAK TEMP., F | 1800 | 2200 | 1500 | 1600 |
| EXIT TEMP., F | 1800 | 1100 | 1050 | 1600 |
| PRESSURE, ATM | 1 | 20 | 1.7 | 1.2 |
| SULFUR REMOVAL | | | | |
| GAS | SCRUB | SCRUB | | |
| LIQUID[d] | | | | LPT |
| CHAR | | | | |
| PARTICLES IN GAS FROM PROCESS, PPM | | 30 | 10,000 | 3000 |
| PARTICLE REMOVAL | | CYC.+SCRUB | 2 CYCLONES | 2 CYCLONES |
| VAPOR EXPOSURE TO HIGH TEMP., s | 500 | 3 | 30 | 2 |

FIG. 4B

TABLE I - A a) DESIGN STUDY ONLY
b) PERCENTAGE OF CHEMICAL ENERGY IN COAL (LOWER HEATING VALUE)
c) COAL SYSTEM ONLY
d) LPT = LIQUID PHASE TREATMENT

COAL SYSTEMS COUPLED TO UTILITY POWER PLANTS

| | | | | | |
|---|---|---|---|---|---|
| ENTRAINED | MOVING | ENTRAINED | BUBBLING | BUBBLING | VIBRATING |
| TEXACO | LUNEN | COOL WATER | WESTINGH'SE[a] | ORNL | FRAAS-SQ'S |
| PYROLYSIS | GASIFIER | GASIFIER | CARBONIZER | PYROLYSIS | PYROLYSIS |
| 7 | 2 | 6 | 8 | 9 | 10 |
| ILLINOIS-6 | BITUMINOUS | BITUMINOUS | BITUMINOUS | KENTUCKY-9 | KENTUCKY-9 |
| | | | | | |
| 66 | 87 | 75 | 20 | 3 | 4 |
| | | | | 14 | 26 |
| | | | | 76 | 68 |
| 66 | | | | 90 | 98 |
| | 37 | 30 | 43 | | |
| | | 5.5 | 0.03 | 0.5 | 0.015 |
| | | | | | |
| 2.5 | 17 | 2.5 | | | 300 |
| 1 | 10,000 | 1 | | 3 | 60 |
| 3200 | 2200 | 3200 | 1000 | 1290 | 1050 |
| 1700 | 1100 | 1700 | 1000 | 1290 | 1050 |
| 40 | 20 | 28 | 18 | 3.5 | 1 |
| | | | | | |
| | CLAUS | CLAUS | | | FBC |
| LPT | | | | | LPT |
| | | | | FBC | FBC |
| | | | | | |
| | | | 200 | 1 | 1 |
| | CYC.+SCRUB | SCRUB | SCRUB | CYCLONE | |
| | | | | | |
| 1 | 3 | 2 | 10 | 6 | 3 |

VIBRATING BED COAL PYROLYSIS SYSTEM

BACKGROUND OF THE INVENTION

The unique features and advantages of the vibrating bed pyrolysis system are best put in perspective by a review of representative systems of the many that have been devised and operated during the past 200 years in efforts to produce liquid and gaseous fuels from coal. In the first of these, byproduct gas from beehive coke ovens came into commercial use about 1800, and soon became so widely used for street lighting that the demand exceeded the supply. The gas yield per ton of coal was greatly increased by periodically shutting off the air and injecting water or steam against the red hot coke to generate $H_2O$ and CO via the water gas reaction, thus consuming all of the coke to produce illuminating gas. This basic method of generating gaseous fuel was widely used until pipelines made less expensive natural gas available in the 1920 to 1960 period. Coke production continued in beehive ovens with recovery of some hydrocarbon liquids as byproducts. These byproducts included "coal oil" which gave a better fuel for oil lamps than whale oil, and was much less expensive.

In 1881 a retort type of coke oven was developed in Germany to minimize the amount of oxygen to which the coal was exposed in the pyrolysis process and thus produce both a better quality of coke and more high value hydrocarbon byproducts. In this approach the coal is placed in a set of slab-shaped chambers roughly a foot thick, 10 ft high, and 20 to 40 ft long. These chambers are placed side by side to form a huge oven in which the coal is heated to about 1800° F. by hot combustion gases circulated through passages in the walls between adjacent chambers. The time for heating the coal charge is long because of the long path for heat flow, and the rate of gas evolution is low because of the compactness of the charge, hence the residence time required per charge is 10 to 20 h. From 1 to 2% of the weight of the coal is given off as condensable hydrocarbons, and about 3% as combustible gases. About a third of the gas is employed to produce the hot combustion gases used to heat the coal. This coking process is still the prime source of coke at the end of the 20th century.

The most successful of the many efforts to develop a superior system for gasifying coal via the water gas reaction is the Lurgi system brought out in Germany in the 1920's. To increase the throughput rate, and thus reduce the capital costs, coal is fed into the top of a large cylindrical vessel, air and steam flow up through a grate at the bottom, and the mass of solids above the grate is stirred slowly to keep the charge mixed and to increase the effective surface area. Ash is drained from the bottom and the gas produced flows out the top of the vessel.

A vital element in Hitler's preparations for World War II included an intensive program to synthesize liquid hydrocarbons for motor fuel from the "wasser gas" produced with Lurgi gasifiers. The program was sufficiently successful that it produced as much as 70,000 barrels per day of motor fuel during WWII, a vital input to the Nazi war effort, but only about 3% of the U.S. petroleum production at that time. Thus, except for the Panzer divisions, much of the German army was horse-drawn.

After WWII, military planners in the U.S. became concerned with the impending depletion of U.S. petroleum reserves, and instigated a program to synthesize motor fuel from coal. This led to a major U.S. national program that took the German work as the point of departure, with improvements derived from petroleum refinery experience including operation at higher temperatures and pressures to improve the yield and the process efficiency. Fluidized beds of coal and relatively inert particles were employed to give a much higher rate of mixing and greater effective surface area than the moving bed in a Lurgi, thus increasing reaction and throughput rates and reducing the capital costs. These U.S. efforts slowly increased in scale until the "Energy Crisis" in the 1970's led to the construction of a series of demonstration plants, Serious troubles with corrosion, coking in retorts, and clogging of lines by tarry deposits together with rapidly escalating estimates of costs led to the cancellation of one after another of these expensive large-scale projects until virtually the entire program was terminated. By 1990 the only large scale plant in the world producing liquid motor fuel from coal was the SASOL plant in South Africa which was heavily subsidized by the government to provide a source of motor fuel in the event of a petroleum embargo. This plant makes use of Lurgi gasifiers and WWII German technology.

A need exists for an improved system for producing fluid fuels and feed stocks from solid hydrocarbon products.

SUMMARY OF THE INVENTION

A coal pyrolysis system of the present invention produces liquid and gaseous hydrocarbons from coal by very rapidly heating a stream of crushed coal particles in a vibrated bed of hot sorbent particles circulated through the pyrolysis bed from a fluidized bed coal combustor.

Other pyrolysis systems have fluidized beds of hot particles with a sweep gas. The present vibrated bed system has several great advantages over bubbling and entrained gas-fluidized beds. First, a vibrated bed can be designed to give nicely controlled, orderly dispersion of the coal particles as they enter and are rapidly heated in the bed; this makes it possible to reduce greatly the probability of a coal particle colliding with another coal particle while both are in the sticky stage (which lasts for about on second during heating). Second, the vibrating action of the bed breaks up any coal particle agglomerates that may form and shakes loose any coal particles that may tend to adhere to the retort walls. As a consequence, it appears that a vibrated bed will permit high coal throughput rates per unit of pyrolysis bed volume without difficulties with coal particle agglomeration and coke formation, and this will reduce the capital and operating costs. Third, the low particle velocities in a vibrating bed largely eliminate particle attrition and the production of fine particles that tend to be carried off with the vapor product and contaminate it in the quench condenser, severely degrading the product liquid by inducing polymerization. Fourth, the pyrolysis vapor is not diluted by a carrier gas required to fluidize the pyrolysis bed to obtain rapid heat transfer and flash pyrolysis, and hence the superficial velocity of the gas and vapor leaving the bed is reduced by a large factor, thus further reducing the tendency toward fine particle carry-over into the liquid product. Elimination of the carrier gas also avoids the large heat loss involved in cooling it when condensing the pyrolysis vapor. Fifth, the drastic reduction in particle carry-over eliminates the need for cyclone separators and thus makes it possible to place the vapor condenser close to the pyrolysis bed so that the hydrocarbon vapor transit time through the hot zone is kept to a minimum, thus reducing the amount of cracking fin the vapor molecules and their subsequent tendency to polymerize during storage of the liquid product. Sixth, by employing a high temperature dryer ahead of the pyrolizer the volume of vapor emitted in the pyrolysis bed is reduced, further reducing elutriation. At the same time, the dryer can be designed so that the large volume of vapor leaving the dryer carries off fine coal particles, further reducing the elutriation of fine carbon particles with the pyrolysis vapor. Seventh, coupling the vibrating bed pyrolysis unit to a fluidized bed combustor to heat the coal with a stream of sorbent from the combustor gives an exceptionally high energy efficiency for the pyrolysis process because the principle energy loss in the process is just that of the sensible heat and the heat of vaporization of the product liquid. Eighth, by choosing a pyrolysis temperature in the 1000° to 1250° F. range the bulk of the pyrolysis product is a liquid at room temperature rather than a gas so that the product storage tank volume required is small and inexpensive. Ninth, discharging the char directly to a fluidized bed combustor avoids the major heat loss that would occur if the char were to be cooled and stored. Tenth, char provides a more desirable fuel than coal for operating a fluidized bed combustor because it is not possible to avoid some irregularities in the feed rate of fluidized crushed coal particles to a furnace, and this in turn leads to vacillations between oxidizing and reducing conditions in the flame plume just above a coal feed port where volatiles are released very rapidly from raw coal. Fluctuations between oxidizing and reducing conditions cause the protective oxide scale to flake off the boiler tubes, introducing a major corrosion problem because the boiler tubes must be exposed directly to the burning particles in fluidized bed coal combustors to maintain the fluidized bed temperature in the proper range. Eleventh, the sulfur sorbent in the fluidized bed combustor also provides for excellent sulfur removal from the pyrolysis vapor as well as from the char when burned in the combustor. Twelfth, all of the gaseous and particulate emissions from the process can be vented to the fluidized bed combustion furnace where they can be burned at around 1600° F. so that the emissions problems of the pyrolysis system are just those of the fluidized bed combustor.

The use of vibration to fluidize a bed of hot solid particles produces a medium with excellent local heat transfer characteristics into which particles of coal or other hydrogenous material can be injected and heated rapidly in a flash pyrolysis process to drive off hydrocarbon vapors. Fluidizing the particle bed by vibration eliminates the sweep gas required for gas-fluidized beds, thus eliminating a major heat loss and drastically reducing elutriation of particles that contaminate the hydrocarbon vapor product. Vibratory motions that can be used include linear, whirl, oscillatory, pitching, or combinations of these designed to minimize particle agglomeration and coke formation on vessel walls.

A high pyrolysis process energy efficiency is obtained by coupling the vibrating bed pyrolysis system with a fluidized bed coal combustor. A bypass stream of hot sorbent particles from the combustor is circulated through the pyrolysis system to heat the coal to the required temperature. That stream of sorbent particles is returned to the combustor with the char which then serves as the fuel for the combustor, which may be used as a heat source for a steam generator.

A vibrating bed or other type of dryer heats the coal to 500° to 600° F. to remove as much moisture as practicable, partly to minimize the water vapor in the product hydrocarbon vapor, and partly to elutriate the fine particulate content of the coal before it reaches the pyrolysis bed.

A jet condenser mounted just above the vibrated bed minimizes the time that the vapor evolved from the bed is exposed to high temperature conditions and thus is subject to progressive cracking or other deterioration.

The vibrating bed pyrolysis system produces char, a fuel that is superior to coal for operation of a fluidized bed coal combustor.

The system may be used for the production of liquid hydrocarbons for petroleum refinery feed stock by skimming off volatiles from the coal used to produce steam in a power plant.

The vibrating bed coal pyrolysis system may fuel any of a wide variety of combined cycle gas turbine-steam power plants, or separate gas turbines in a power plant.

The vibrating bed pyrolysis system may be used for the pyrolysis of oil shale, residual fuel oil, solid wastes, and other sources of hydrocarbons.

These and further and other objects and features of the invention are apparent in the disclosure, which includes the above and ongoing written specification, with the claims and the drawings.

BRIEF DESCRIPTION OF THE DRAWINGS

FIGS. 4A and 4B show Tables I and IA, which are a comparisons of parameters for coal pyrolysis systems.

DETAILED DESCRIPTION OF THE DRAWINGS

Figure 1:
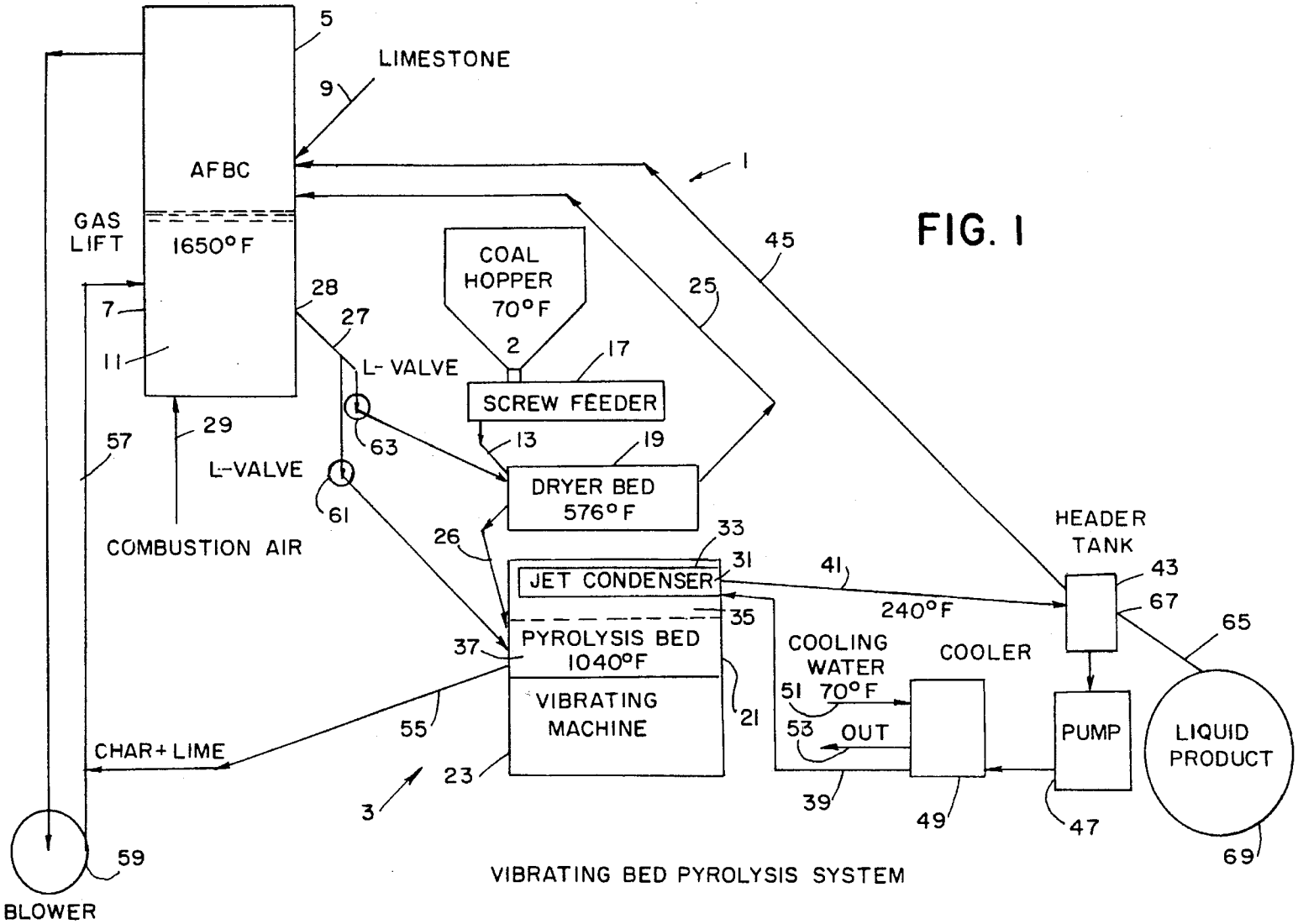
FIG. 1 shows a schematic diagram for a representative embodiment of the vibrating bed coal pyrolysis system.

There are many ways in which the invention can be employed in a power plant utilizing a fluidized bed combustor. FIG. 1 shows a representative coal converter and combustor system 1 in which the vibrated bed pyrolysis system 3 is coupled to an atmospheric fluidized bed coal combustion furnace 5, commonly referred to as an AFBC. The fluidized bed 7 in this type of furnace usually consists mostly of limestone 9 or dolomite that calcines on heating to form CaO, a sorbent that gives good retention of the $SO_2$ formed from the sulfur in the coal as it is burned at a temperature in the 1500° to 1650° F. range. Thus the bulk of the solid particles 11 in the bed are CaO coated with a hard layer of $CaSO_4$. Crushed coal 13 is fed from a supply hopper 15 through a screw feeder 17 to a vibrating bed coal dryer 19 mounted next to the vibrating bed pyrolysis retort 21. The two vibrating beds are mounted on a vibrating machine 23. The dryer preheats the coal to around 576° F. to drive off the superficial moisture before the coal enters the pyrolysis bed, which will commonly operate in the temperature range of about 1000° F. to 1250° F. for the best yield of products (depending on the coal used).

Removing the moisture reduces elutriation of fine solids with the pyrolysis products by reducing the superficial velocity of the gases leaving the pyrolysis bed by a factor that would run roughly two if the superficial moisture content of the coal were 4%. Although the liquid hydrocarbon yield would run perhaps 24% of the weight of the coal, the molecular weight of water is only 18 whereas the mean molecular weight of the hydrocarbon molecules will run about 180, so that the volume of vapor from the superficial moisture is roughly double that of the of the vapor constituting the liquid hydrocarbon product. Designing the system so that the superficial velocity of the water vapor leaving the vibrated bed in the dryer is substantially higher than that for the pyrolysis bed serves to remove with the water vapor the majority of the fine particles from the coal before it reaches the pyrolysis bed. The water vapor and coal fines are flowed to the combustor 5 through pipe 25 for burning the fines. The crushed coal particles and the hot solid particles from the combustor flow to the pyrolizer 21 as shown by line 26.

The point at which the sorbent stream 27 is tapped 28 from the combustor is chosen to minimize the amount of fines, and the high combustion air flow 29 through the fluidized bed in the furnace will naturally carry off practically all of the smaller particles as they are generated by attrition in the AFBC. Thus the amount of fine particles available for elutriation from the pyrolysis bed is minimized. Including the dryer 19 in the system is also advantageous in that it preheats the coal and increases the heating rate of the particles in the pyrolysis bed and thus reduces the time during which a particle might have a sticky surface and contribute to agglomeration and coking. Further, the dryer reduces moisture contamination of the product liquid.

To minimize the time that the product vapor is exposed to high temperature, a jet condenser 31 enclosed within a thermally-insulated sleeve 33 is mounted in the freeboard 35 above the pyrolysis bed 37 to quench the hydrocarbon vapor product with a recirculated stream of the product liquid that has been cooled to just above the boiling point of water; operating the condenser 31 in this temperature range minimizes the amount of moisture in the hydrocarbon condensate 41. The spray of droplets provides a large surface area in a compact condenser whose effectiveness will not be degraded by the formation of tarry deposits on heat transfer surfaces. The liquid and gaseous pyrolysis products 41 leaving the jet condenser drain down to a header tank 43 having sufficient volume so that the liquid collects in the lower part of the tank while the noncondensable vapors and gases 45 leave at the top and flow to the AFBC furnace along with the water vapor 25 leaving the dryer.

The quench liquid 39 is pumped to the jet condenser 31 by the pump 47 through the cooler 49, where it is cooled by flowing ambient water 51 in and hot water 53 out.

The stream 55 of char and sorbent leaving the pyrolysis bed is returned to the AFBC furnace by a gas lift 57 driven by a blower 59. The power required to drive the vibrating machine 23 and the gas lift blower 55 is about 0.1% of the net plant electrical output. That compares with about 0.6% for the power required for the coal pulverizers in a conventional pulverized coal-fired steam power plant.

The flow 27 of hot sorbent from the AFBC to the vibrating beds is controlled by L-valves 61 and 63 that also serve as flow meters.

Product liquid 65 drains out through an overflow port 67 in the header tank 43 into the storage tank 69.

From the environmental standpoint, the emissions are the same as for fluidized bed combustors fired with raw coal in the conventional fashion; installation of the pyrolysis system does not require any additional equipment to control emissions.

The vibrating bed pyrolysis system is equally applicable to bubbling or entrained fluidized bed combustors, and can be used with atmospheric or pressurized fluidized bed combustors. The space required for the equipment of the vibrating bed pyrolysis system is about the same as for coal pulverizers.

When applied to combined cycle power plants, the vibrating bed pyrolysis system has an advantage over any of the gasifiers employed to date in that it gives cleaner fuel for the gas turbine with a relatively low cost fuel cleanup system. That stems in part from the low elutriation rate of solid particles with the hydrocarbon vapor, and in part from the much smaller size and cost of the cleanup equipment required for as compared to that for gases. Further, the low volume requirements for liquid as opposed to gas storage would have the major advantage of providing great flexibility in accommodating wide swings in the electrical load, e.g., separate peaking power gas turbines could be employed. The vibrating bed pyrolysis system operates with a small inventory of fuel in process and its performance is insensitive to turn-down, so that the rate of change in the electrical load would not be limited by the pyrolysis system (as is the case with a Lurgi gasifier), and the plant would not be forced to operate as a base-load plant by peculiarities in the behavior of the coal gasification system under part-load conditions.

While the system of FIG. 1 is representative, there are many variations that might be made in the design to meet the requirements of other potential applications of the vibrating bed pyrolysis system. These include other ways of drying the coal, the use of a hydrogen donor or other special liquids for the vapor quench condenser, various types of spray condensers, and tubular or other types of heat transfer surfaces. The gas lift for returning the sorbent-char mixture to the FBC might be replaced with a chain of buckets or other mechanism, an upwardly-inclined vibrating trough, or the need for such a device might be obviated by clever arrangement of the components to permit gravity flow.

The extremely small energy losses of the vibrating bed pyrolysis process make it unnecessary to employ a complex coupling of components to recover waste heat from the pyrolysis process for utilization in the power plant to improve the thermal efficiency. For example, the power plants in the first three columns in the right hand portion of Table 1 require close integration of cooling elements in the gasifier systems with the steam power plant feedwater heating systems and economizers in the air and steam systems. Avoiding this complication by using the vibrating bed pyrolysis system greatly simplifies the plant design, piping, system control, operation, and maintenance, thus reducing both capital and operating costs.

In advanced forms of the system it would probably be economically advantageous to recover hydrogen and low molecular weight hydrocarbons from the gas and vapors leaving the jet condenser before sending that stream to be burned in the fluidized bed combustor furnace. Other potentially advantageous elaborations include use of a particularly effective sorbent for sulfur carryover in the liquid product, possibly in connection with a hydrogen donor liquid for the quenching operation in the jet condenser.

Table 1 summarizes key data for a representative set of coal gasification and liquefaction plants to facilitate comparison of their principal features and characteristics with those of the proposed system. The first system at the left of the table is the fixed bed coke oven that has been used for over 100 years to produce coke with a few percent by weight of the coal emerging as by-product gas and liquid hydrocarbons. Note that the coal feed rate per cubic foot of retort volume is low because the coal transit time through the system is 10 to 20 hours. The second system, the moving bed Lurgi gasifier which has been in use for over 50 years, has a higher throughput rate with a coal transit time of 2 to 3 hours.

In the 1960's a new approach to coal liquefaction called "flash pyrolysis" received much attention. This depends on the fact that if coal particles can be heated very rapidly to a temperature in the 1000° to 1200° F. range the polymers forming the raw coal are cracked to form hydrocarbons having molecular weights of the order of 180 rather than hydrogen, methane, and a few light hydrocarbons.

Figure 2:
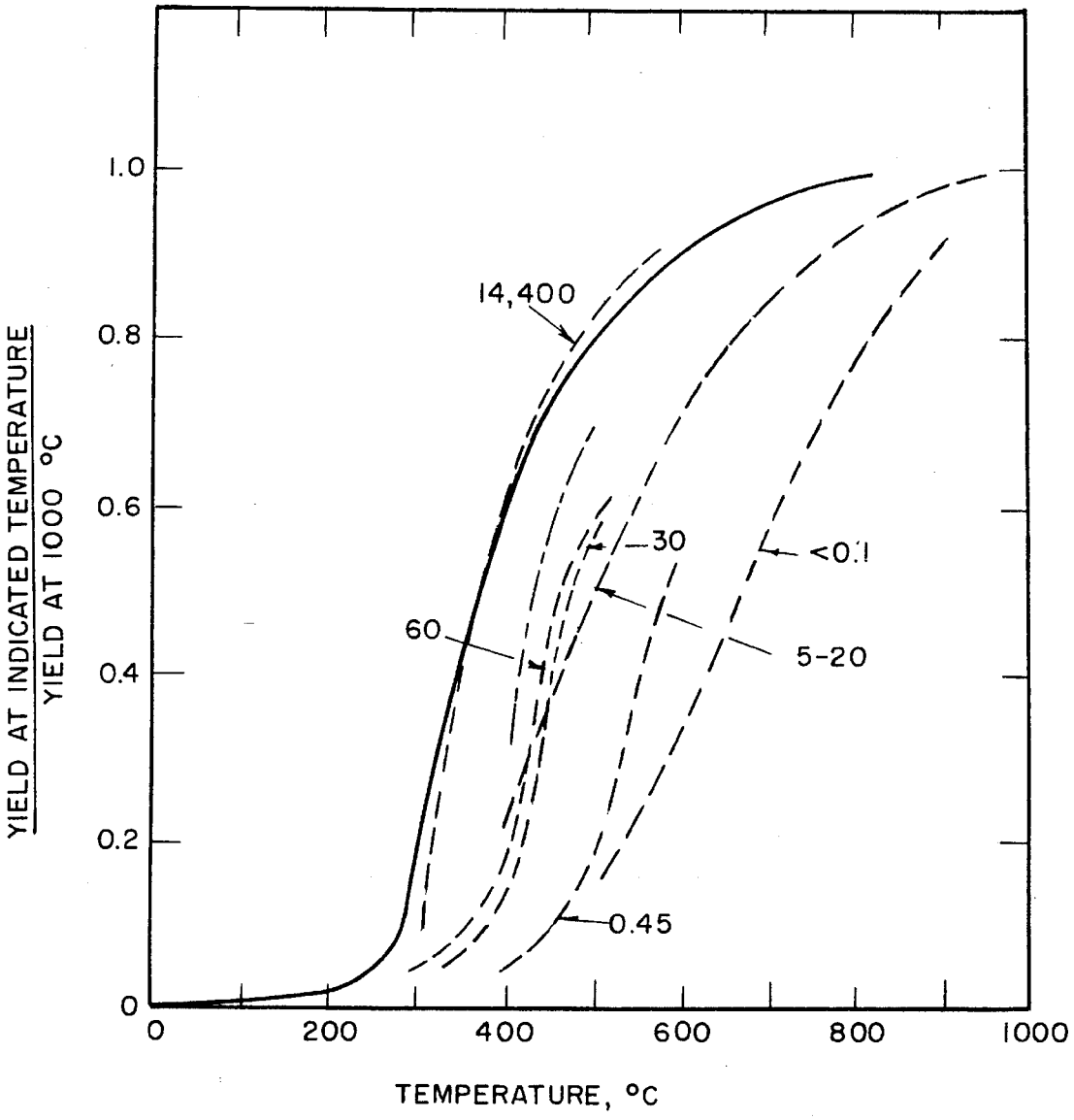
FIG. 2 is a chart showing effect of temperature on pyrolysis yields at indicated temperatures.

The yield as a function of the pyrolysis temperature is shown in FIG. 2 for a series of particle transit times through the pyrolizer in prior art systems. There it may be seen that the conversion of interest takes place in a short time, less than one minute.

Figure 3:
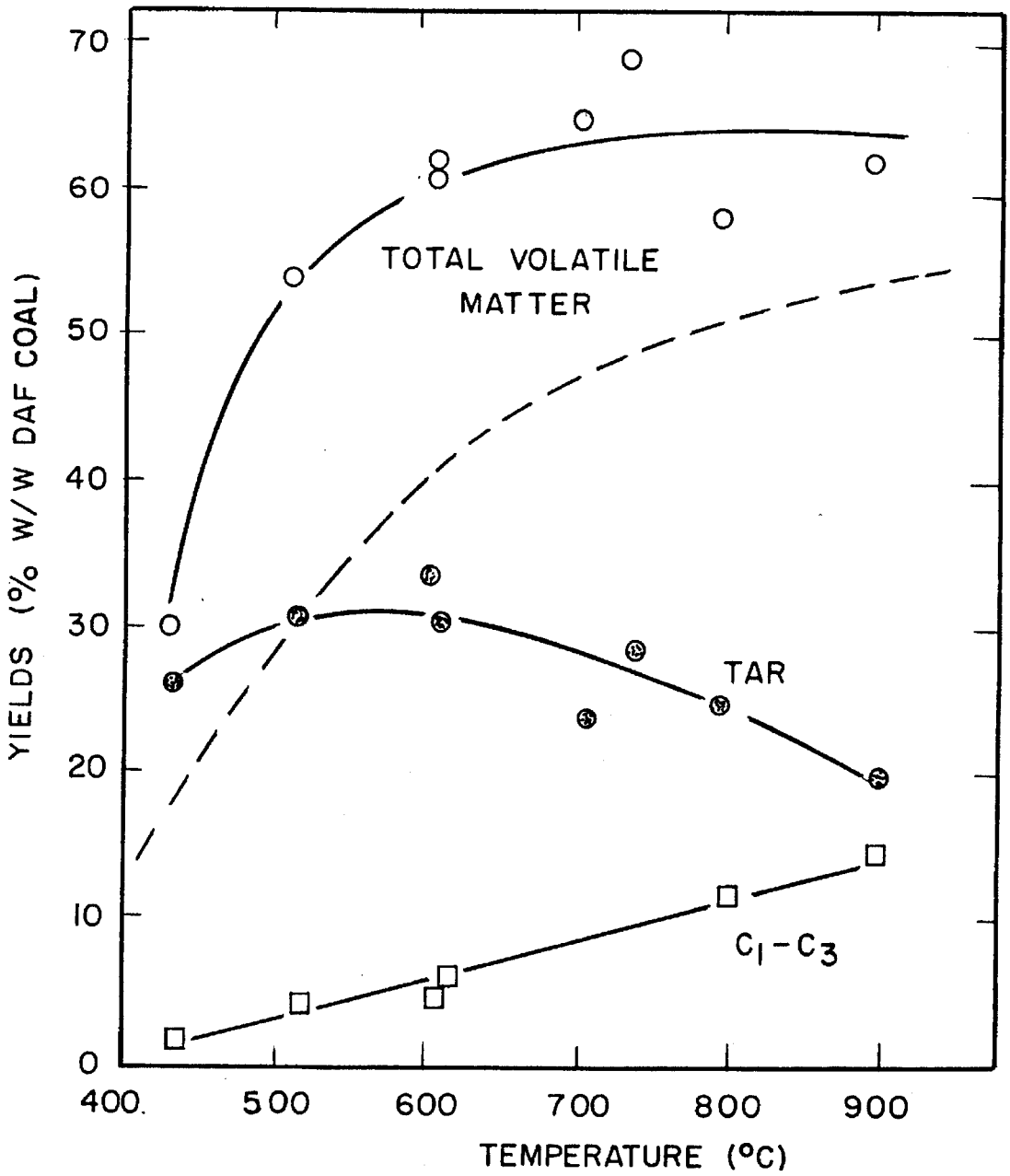
FIG. 3 is a chart showing effect of temperature on pyrolysis yields at indicated temperatures from Pittsburgh coal.

FIG. 3 shows the effect of temperature on pyrolysis yields from Pittsburgh coal. The data is shown for grid heating, corrected to a DAF basis after allowing for coal moisture.

Two of the most promising systems developed to exploit this new approach with fluidized beds are included in the third and fourth columns of Table 1. The third column in Table 1 is for the COED bubbling fluidized bed which operates at a lower temperature than either the coke oven or the Lurgi gasifier so that the pyrolysis process yields a substantial amount of liquid with some gas, the balance of the coal emerging as char. The throughput for this system is somewhat higher than for the Lurgi. The fourth system, the Occidental Research entrained bed, has a much shorter coal transit time than in the COED process, but the coal is only a small fraction of the volume of the circulating bed so that the feed rate per cubic foot of retort volume is actually lower than for either the Lurgi or the COED process. The same low feed rate is found for the fifth system, the Texaco entrained bed process, which is an advanced version of the Lurgi that operates at a much higher temperature and also yields only gas.

Energy losses in all five of these systems are substantial. These stem from heat and unburned carbon leaving with the ash, heat lost in cooling the product with its carrier gas so that the liquid can be condensed and both the liquid and the gas can be treated to remove sulfur and particulates, heat lost to the stack for the combustor employed to supply heat to the process, power to make oxygen if this is required, and heat losses to the walls of the process vessels and piping. Much of this heat can be used to good advantage for feed water heating if the gasifier or pyrolysis unit is closely integrated with a steam power plant.

The right hand portion of Table 1 shows data for representative gasifier or pyrolysis systems coupled to electric utility plants. The primary design objective usually is to supply clean fuel to gas turbines in combined cycle steam plants and thus obtain a high overall thermal efficiency with low cost, high sulfur coal and yet meet strict requirements on stack emissions. Thus one of the most vital criteria is the overall thermal efficiency for the production of electric power, yet the values achieved for this parameter in the plants of the first two columns of this section are no better than for a conventional steam plant. This stems largely from losses in the gasifiers with their gas cleanup systems, partly because the allowable level for particulates in the gas stream entering the gas turbine is much lower than the EPA limit for stack gas. Yet it is vital that the gas cleanup system do an excellent job to avoid erosion or deposits in the gas turbine caused by particulates that carry through the system from the coal. In the Lunen plant the difficulties in reducing the level of particulates proved so formidable that the project was terminated after over 5 years of effort to operate the plant. A different but very complex system was employed in the Coolwater plant; it operated satisfactorily but was expensive and was a major factor in reducing the thermal efficiency. Note that the thermal efficiency of the Coolwater plant is seriously degraded because about 15% of the gross electrical output goes to making oxygen for the Texaco gasifier; that fraction would be lower in a larger-scale plant. The Westinghouse design of the next column was prepared in an effort to obtain the highest thermal efficiency that seemed possible, partly by making use of a fluidized bed combustor to remove the sulfur. The report gives an excellent quantitative analysis of the effects of particulates on gas turbines and concludes that it is essential to keep the particulate content exceedingly low to obtain an acceptable turbine life. It achieves such a system by heating the air to the gas turbine by passing it through tubes in the furnace, then heating it further by burning some pyrolysis gas from the coal going through a carbonizer cell as it enters the furnace. The gas turbine exhaust serves as the combustion air for the fluidized bed combustor.

The fourth column in the right hand portion of Table 1 is for an entrained bed flash pyrolysis system coupled to a bubbling fluidized bed furnace supercharged with gas turbines. These turbines would operate with an inlet temperature of about 1000° F., just high enough to provide the combustion air at 3.5 atm and thus reduce the size and cost of the furnace casing and improve both the sulfur retention and combustion efficiency by increasing the depth of the bed. The 1000° F. turbine inlet temperature is below that at which turbine blade erosion and deposits become serious problems, though not high enough to produce much electric power. In this study the pyrolysis system was designed to produce liquid hydrocarbon feed stock for refining into motor fuel rather than fuel for gas turbines in a combined cycle because it seemed to offer a more attractive way to produce motor fuel from coal than any system previously proposed. However, further work on this system was dropped when it was found that a number of experiments had shown that gas fluidized bed pyrolysis units would badly contaminate the liquid product with fine particulates, and that the fine carbon particles would be so chemically active that in a few days the liquid product would be polymerized into intractable gunk that could not be handled in a refinery. (Note in Table 1 that, in tests of both the COED bubbling bed and the Occidental entrained bed, particulates ran 3 to 10% by weight of the condensable hydrocarbon product, and that in other systems the particulates ran as much as 30% by weight.)

The right hand column of Table 1 is for a system similar to that in the previous column, but a vibrating bed rather than an entrained bed was used in the pyrolysis system in order to reduce drastically the amount of particulates carried off with the pyrolysis vapor. In the first place, the tendency to elutriate particles depends on the superficial velocity of the gas leaving the pyrolysis bed, and this is lower by a factor of about ten relative to that for a bubbling bed that must be fluidized with a carrier gas, and lower by a factor of about 100 relative to an entrained bed which inherently requires a still higher velocity in the carrier gas. Further, the formation of fines by attrition and decrepitation of the fluidized particles depends on the velocity at which particles impact, and this is generally less than 1 ft/s in the vibrated bed as compared to about 10 ft/s in the bursting gas bubbles at the surface of a bubbling bed and about 30 ft/s in an entrained bed. The impact stresses are directly proportional to the impact velocity, and will not tend to damage the particles if the impact velocity is below a critical level. The situation can be illustrated by dropping a glass marble on a ceramic tile floor from progressively greater heights. The glass surface will remain undamaged up to a height of about 4 ft (giving an impact velocity of 16 ft/s), at which point a small chip will sometimes be spalled from the impact surface. In fluidized beds, operating experience with silica sand has shown no evident decrepitation in 30 h of operation in vibrating beds, a moderate rate of decrepitation in a few hours of operation in bubbling beds, and a substantial rate in only a few minutes in an entrained bed. Attrition and elutriation rates are much higher with softer materials such as limestone.

As in the previous system, using hot lime from the fluidized bed combustor to heat the coal in the pyrolysis bed gives a high thermal efficiency for the pyrolysis process. With the vibrating bed the efficiency is even higher because there is no heat loss to a carrier gas that must also be cooled when quenching and condensing the hydrocarbon product. In either system there is no heat loss to the char because it flows directly to the furnace and would have to be heated anyway to burn it, and no heat loss to the lime used for heating the coal because it is fed directly back to the fluidized bed. The vibrating bed system has the further advantage that the vapor transit time through the hot zone can be cut to a few seconds, thus minimizing the amount of cracking of the hydrocarbon molecules and their tendency to polymerize. Placing the condenser close to the pyrolysis bed is possible because dust entrainment from the vibrating bed is so low that cyclone separators with their attendant piping are not required.

While the amount and quality of the pyrolysis liquid product are primary considerations, the routine operability of any process is also a vital consideration. Those working in the field of coal gasification and liquefaction have been repeatedly frustrated by the formation of coke deposits so massive as to bring the whole process to a halt. They have found that coking usually presents problems so intractable that the type of coal that could be used is severely limited, and the coal throughput rate has to be kept low so that the raw coal represents only a small fraction of the total amount of particulate matter active in the process. Even the rugged stirring equipment used in the Lurgi gasifier will stall unless a non-caking coal is employed.

The tendency toward caking and coking can be reduced by a small amount of preoxidation of the coal. However, the affinity of oxygen for hydrogen is greater than that for carbon, so that valuable hydrogen is lost in the process. This loss commonly runs around 30% of the total hydrogen content, and not only reduces the quantity of the liquid hydrocarbon product but also reduces the quality by yielding a higher average molecular weight.

While the bubbling, entrained, and vibrated beds of fluidized particles may seem similar, observation of these three types of fluidized bed in operation discloses that the particle motion is very different, and that the tendency to form coke deposits can be greatly reduced in a vibrated bed.

A bubbling bed looks much like a pot of violently boiling water, but with the fluidized bed of particles churned by bubbles of gas rather than bubbles of steam. In a bubbling bed of fluidized particles the gas bubbles rise rapidly to the surface where they explode like miniature volcanoes, sending clouds of particles up into the plenum above the bed. This plenum is ordinarily about six feet high to give the particles ejected an opportunity to settle back into the bed and thus reduce the amount of solids carried off by the gas leaving at the top of the plenum. Particle movement within the bed is characterized by chaotic, random turbulence so that there is a substantial probability that a given coal particle will collide with a wall while heating through the stage during which the surface is sticky. There is an even higher probability that a given coal particle will collide with another coal particle while both are in the sticky stage in the course of heating up to the bed temperature. The particle adhesion process may proceed and lead to agglomeration of particles into large clumps, and possibly into masses of coke, The duration of the sticky stage varies somewhat with the type of coal. Particle size is much less of a factor than one might expect because the heat transfer rate to the particle in a fluidized bed is very high relative to the thermal conductivity of the coal, hence the surface layer of even a large particle heats very rapidly and the volatiles evaporate so quickly that the surface is sticky for only about a second even though the it may take quite a few seconds for the center of the particle to reach bed temperature. To reduce the tendency toward agglomeration, the concentration of fresh coal particles must be kept to a small fraction of the total either by dilution with inert particles such as sand or crushed limestone, or by keeping the coal throughput rate low, or by both measures.

In an entrained bed the motion of individual particles is that of the highly turbulent gas in which they are suspended. The churning action is random and unpredictable, but the there is a substantial probability of particles colliding with each other or a wall while they are in the sticky stage. This probability must be kept to an acceptable level by keeping the coal throughput low enough so that the concentration of fresh coal particles is not very high.

Particle motion in a vibrated bed is remarkably orderly instead of chaotic; individual particles dance up and down in a coordinated fashion rather like a troupe of ballet dancers. If the floor of the bed is inclined, or if the axis of the vibratory motion is inclined from the vertical, the whole bed of particles will move in the direction of the inclination, the dancing particles moving in unison like a column of well-drilled soldiers marching in step. In fact, the principal use of vibrated beds has been for conveying bulk materials such as powders or crushed ceramics. The lateral velocity at which the vibrated particles move across the vibrating plate forming the floor of the bed can be controlled with remarkable precision by varying the frequency or amplitude of the vibration. Thus vibrating troughs or tables are often employed to control and meter the flow of solids in chemical processes. In addition to varying the amplitude or frequency of the vibration, the solids flow rate can be varied by changing the inclination of either the floor of the bed or the axis of vibration, the depth of the bed, or some combination of these parameters. This controllable, orderly behavior of a vibrated bed makes it possible to control the flow of coal particles into a pyrolysis bed so that they are nicely dispersed in such a way that the probability of a coal particle colliding with a wall or another coal particle while in the sticky stage can be much lower than in a bubbling or entrained bed. For example, a broad thin stream of coal particles might be allowed to fall into a vibrated bed in which hot non-sticky particles flow under the coal feed spout. The resulting nicely controlled dispersion of fresh coal particles should make it possible to employ a much wider range of coal types, and do this with a higher coal throughput rate. Further, the lateral mixing rate in a vibrated bed is relatively low so that the stream of coal can be directed into the bed in such a way that coal particles will not migrate across the stream and impinge on a wall before they have been heated beyond the sticky stage. Even if one should stick to a wall for a time, the incessant vibration will act to shake it loose, much as vibrators on bins serve to prevent bridging and flow blockage. Vibrating the bed also tends to break up any agglomerates of particles if they form, a characteristic well demonstrated in vibrating conveyor troughs employed for drying brown sugar.

Analyses indicate that the coal throughput rate per unit of bed volume for a well-designed vibrating bed pyrolysis system may be as much as one hundred times that of either the bubbling or entrained beds because of the rapid transit time and the excellent controlled particle motion obtainable, hence the capital costs should be drastically lower than for the other systems. The relatively low pyrolysis temperature of 1050° F. together with the low operating pressure for the projected system are also important factors that will help keep capital costs low.

While the invention has been described with reference to specific embodiments, modifications and variations of the invention may be constructed without departing from the scope of the invention, which is defined in the following claims.

I claim:

1. A method of producing fluid fuel and feed stock by coal pyrolysis, comprising crushing coal into particles, providing a bed of heated sorbent particles, vibrating the bed of hot sorbent particles by mounting the bed on a vibrating machine, introducing a stream of crushed coal particles to the vibrating bed of heated sorbent particles, rapidly heating the crushed coal particles in the vibrating bed of heated sorbent particles, creating gaseous products from the coal, withdrawing the gaseous products, condensing part of the gaseous products and storing the condensed products.

2. The method of claim 1, further comprising orderly dispersing of the coal particles entering the vibrating bed.

3. The method of claim 1, further comprising breaking up coal particles agglomerates that may form and producing char particles.

4. The method of claim 1, further comprising heating the heated sorbent particles in a fluidized bed coal combustor and circulating the heated sorbent particles from the fluidized bed coal combustor into the vibrating bed, and out of the vibrating bed back into the fluidized bed coal combustor, and further comprising forming char from the coal particles from which gaseous products have been produced, and introducing the char into the fluidized bed coal combustor as fuel for the combustor.

5. The method of claim 4, further comprising maintaining coal throughput through the fluidized bed, and preventing coal particle agglomeration in the vibrating bed, maintaining particle velocities in the vibrating bed, and largely eliminating particle attrition and production of fine particles, and preventing fine particles from being entrained in the gaseous products.

6. The method of claim 5, further comprising maintaining velocity of gaseous products leaving the vibrating bed at a low velocity, and reducing fine particle entrainment by the gaseous products.

7. The method of claim 4, wherein the gaseous products comprise pyrolysis vapors, and further comprising cooling and condensing the pyrolysis vapors in a vapor condenser positioned close to the vibrating bed, and maintaining minimal vapor transit time through a heated zone above the vibrating bed and reducing cracking of vapor molecules in the heated zone.

8. The method of claim 4, further comprising supplying heated sorbent particles from the fluidized bed to a high temperature dryer ahead of the vibrating bed pyrolizer, and flowing coal particles in contact with the heated sorbent particles in the dryer and emitting water vapor from the crushed coal particles in the dryer, thereby reducing elutriation in the vibrating bed pyrolizer.

9. The method of claim 8, further comprising entraining fine coal particles in the water vapor and flowing the water vapor and entrained fine coal particles to the coal combustor.

10. The method of claim 1, further comprising maintaining the vibrating bed at a temperature from about 900° F. to 1250° F. and producing a pyrolysis product that is liquid at room temperature.

11. A method of coal pyrolysis, comprising vibrating a bed of heated solid particles by mounting the bed on a vibrating machine, crushing coal into coal particles and flowing the coal particles through the vibrating bed, rapidly heating the coal particles with the heated solid particles and driving off hydrocarbon vapors from the coal particles in flash pyrolysis, cooling and condensing the hydrocarbon vapors above the vibrating bed to liquid hydrocarbon product and removing and storing the liquid hydrocarbon product from the coal pyrolysis.

12. The method of claim 11, further comprising flowing heated solid particles into the vibrating bed from a fluidized bed coal combustor, transferring heat from the heated particles to the coal particles and returning the solid particles to the fluidized bed combustor, transferring coal char to the fluidized bed combustor and combusting the char in the combustor.

13. The method of claim 12, further comprising flowing non condensed hydrocarbon gas from the condenser to the combustor.

14. The method of claim 11, further comprising providing heated solid particles to a dryer bed, flowing crushed coal particles into the dryer bed, heating the crushed coal particles from about 100° F. to about 600° F., vaporizing moisture in the crushed coal particles, entraining coal fines in the vaporized moisture and flowing the vaporized moisture and entrained coal fines to the coal combustor, and flowing the crushed coal particles from the dryer to the vibrating bed pyrolizer.

15. The method of claim 11, further comprising withdrawing a portion of the condensed liquid hydrocarbon product, cooling the portion of condensed liquid hydrocarbon product and spraying the withdrawn and cooled liquid hydrocarbon product into a jet condenser above the pyrolysis bed, and cooling and condensing pyrolysis hydrocarbon vapors in the jet condenser, storing a second portion of the condensed liquid hydrocarbon product from the condenser and recirculating and cooling a portion of the liquid hydrocarbon product for return to the jet condenser.

* * * * *